US012757928B2

(12) United States Patent
Ahn et al.

(10) Patent No.: US 12,757,928 B2
(45) Date of Patent: Oct. 13, 2026

(54) SMOKING ARTICLE INCLUDING BIODEGRADABLE CIGARETTE PAPER

(71) Applicant: KT&G CORPORATION, Daejeon (KR)

(72) Inventors: Ki Jin Ahn, Daejeon (KR); Man Seok Seo, Seoul (KR); Soo Ho Kim, Chungcheongbuk-do (KR); Jong Yeol Kim, Sejong (KR); Kyeng Bae Ma, Incheon (KR); Bong Su Cheong, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 690 days.

(21) Appl. No.: 17/420,742

(22) PCT Filed: Mar. 16, 2021

(86) PCT No.: PCT/KR2021/003243

§ 371 (c)(1),
(2) Date: Jan. 31, 2023

(87) PCT Pub. No.: WO2021/246624

PCT Pub. Date: Dec. 9, 2021

(65) Prior Publication Data

US 2023/0217987 A1 Jul. 13, 2023

(30) Foreign Application Priority Data

Jun. 4, 2020 (KR) ..... 10-2020-0067780

(51) Int. Cl.

| | |
|---|---|
| ***A24D 1/02*** | (2006.01) |
| ***A24D 1/04*** | (2006.01) |
| ***A24D 1/20*** | (2020.01) |
| ***A24F 40/20*** | (2020.01) |
| ***D21H 13/24*** | (2006.01) |
| ***D21H 17/67*** | (2006.01) |

(52) U.S. Cl.

CPC ..... *A24D 1/02* (2013.01); *A24D 1/045* (2013.01); *A24D 1/20* (2020.01); *A24F 40/20* (2020.01); *D21H 13/24* (2013.01); *D21H 17/675* (2013.01)

(58) Field of Classification Search

None

See application file for complete search history.

(56) References Cited

U.S. PATENT DOCUMENTS

| | | | |
|---|---|---|---|
| 6,615,840 | B1 | 9/2003 | Fournier et al. |
| 10,165,794 | B2 | 1/2019 | Besso et al. |

(Continued)

FOREIGN PATENT DOCUMENTS

| | | | | |
|---|---|---|---|---|
| CN | 103929987 | A | 7/2014 | |
| CN | 105672034 | A * | 6/2016 | ..... D21H 21/16 |

(Continued)

OTHER PUBLICATIONS

KR 20130035670 A English Translation obtained from DAV, pp. 1-8 (Year: 2013).*

(Continued)

*Primary Examiner* — Philip Y Louie
*Assistant Examiner* — Madeleine P Delacruz
(74) *Attorney, Agent, or Firm* — Sughrue Mion, PLLC

(57) ABSTRACT

The present disclosure relates to a smoking article including biodegradable cigarette paper.

11 Claims, 3 Drawing Sheets

(56) References Cited

U.S. PATENT DOCUMENTS

| | | | | |
|---|---|---|---|---|
| 2011/0217523 | A1* | 9/2011 | Huang | B32B 27/10 428/323 |
| 2013/0025611 | A1* | 1/2013 | Rushforth | A24D 3/14 131/332 |
| 2014/0305448 | A1 | 10/2014 | Zuber et al. | |
| 2014/0311508 | A1* | 10/2014 | Besso | A24D 1/002 131/108 |
| 2015/0059996 | A1* | 3/2015 | Zitturi | A24D 3/02 162/139 |
| 2015/0289561 | A1* | 10/2015 | Nappi | A24D 3/02 131/331 |
| 2017/0027234 | A1 | 2/2017 | Farine et al. | |
| 2018/0235286 | A1 | 8/2018 | Robinson et al. | |
| 2020/0029616 | A1 | 1/2020 | Uthurry | |
| 2020/0329758 | A1* | 10/2020 | Bonici | A24D 1/20 |

FOREIGN PATENT DOCUMENTS

| | | | | |
|---|---|---|---|---|
| CN | 207505912 | U | 6/2018 | |
| CN | 210043187 | U | 2/2020 | |
| EP | 2 775 868 | B1 | 3/2017 | |
| JP | 2014-532433 | A | 12/2014 | |
| KR | 10-1001077 | B1 | 12/2010 | |
| KR | 20130035670 | A * | 4/2013 | A24D 1/025 |
| KR | 10-2013-0088498 | A | 8/2013 | |
| KR | 10-1375774 | B1 | 3/2014 | |
| KR | 10-1787816 | B1 | 10/2017 | |
| KR | 10-2020-0009016 | A | 1/2020 | |
| WO | 2012/061249 | A2 | 5/2012 | |
| WO | 2012120001 | A1 | 9/2012 | |
| WO | 2013068100 | A1 | 5/2013 | |
| WO | 2013/187676 | A1 | 12/2013 | |
| WO | WO-2020089090 | A1 * | 5/2020 | A24D 1/18 |

OTHER PUBLICATIONS

CN-105672034-A English translation obtained from Espacenet, pp. 1-9 (Year: 2016).*

Extended European Search Report dated May 6, 2022 in European Application No. 21746629.1.

International Search Report of PCT/KR2021/003243 dated Jun. 28, 2021 [PCT/ISA/210].

Japanese Office Action dated Sep. 27, 2022 in Japanese Application No. 2021-536254.

Communication dated Apr. 26, 2023 issued by the State Intellectual Property Office of the P.R. China in application No. 202180006027.X.

Communication dated Mar. 22, 2023 issued by the Japanese Patent Office in application No. 2021-536254.

* cited by examiner

SMOKING ARTICLE INCLUDING BIODEGRADABLE CIGARETTE PAPER

CROSS REFERENCE TO RELATED APPLICATIONS

This application is a National Stage of International Application No. PCT/KR2021/003243 filed on Mar. 16, 2021, claiming priority based on Korean Patent Application No. 10-2020-0067780 filed on Jun. 4, 2020.

TECHNICAL FIELD

The present disclosure relates to a smoking article including biodegradable cigarette paper.

BACKGROUND ART

When cigarettes used for smoking are directly buried in soil, serious environmental pollution may occur. In this regard, research on cigarette paper or tip paper surrounding tobacco media or filters, in general combustion-type cigarettes or heating-type cigarettes, has been actively conducted.

DESCRIPTION OF EMBODIMENTS

Technical Problem

Provided is biodegradable cigarette paper for being used in smoking articles.

The technical problems to be achieved by the present disclosure is not limited to the technical problems described above, and other technical problems may be inferred from the following embodiments.

Solution to Problem

According to an aspect of the present disclosure, a smoking article includes a first portion including a tobacco element, a second portion including a cooling element, and a third portion including a filter element, wherein the first portion, the second portion, and the third portion are arranged in order in a longitudinal direction of the smoking article, and the smoking article further includes biodegradable cigarette paper surrounding at least one of the second portion and the third portion.

Means for solving the problem are not limited to the above description and may include all matters that may be inferred by a person skilled in the art throughout the present specification.

Advantageous Effects of Disclosure

Biodegradable cigarette paper according to the present disclosure may be improved in physical properties of at least one of biodegradability, a tensile strength, an elongation rate, adhesiveness, and printability.

In addition, a smoking article to which biodegradable cigarette paper is applied, according to the present disclosure may increase the amount of atomization when heated.

Effects of the present disclosure are not limited to above description and may include all effects that may be inferred from the configurations to be described below.

BEST MODE

Figure 1:
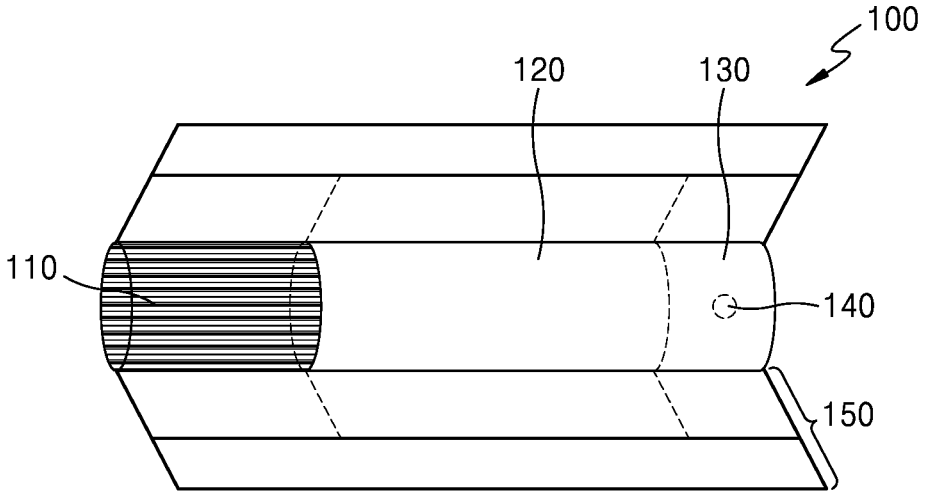
FIG. 1 is a view schematically illustrating a smoking article according to a first embodiment.

According to an aspect of the present disclosure, a smoking article includes a first portion including a tobacco element, a second portion including a cooling element, and a third portion including a filter element, wherein the first portion, the second portion, and the third portion are arranged in order in a longitudinal direction of the smoking article, and the smoking article further includes biodegradable cigarette paper surrounding at least one of the second portion and the third portion.

In an embodiment, the biodegradable cigarette paper may have no pores.

In an embodiment, the biodegradable cigarette paper may include a biodegradable polymer, and the biodegradable polymer may include polylactic acid (PLA) or polybutylene adipate terephthalate (PBAT).

In an embodiment, the biodegradable cigarette paper may further include calcium carbonate (CaCO3).

In an embodiment, the biodegradable cigarette paper may be completely decomposed after 200 days in composting conditions of a temperature of 58° C. and humidity of 70%.

In an embodiment, the biodegradable cigarette paper may have a basis weight of about 100 g/m$^2$ to about 130 g/m$^2$ and have a tensile strength of about 3 kgf/15 mm to about 8 kgf/15 mm.

In an embodiment, when the biodegradable cigarette paper surrounds the third portion, the third portion may have suction resistance of about 150 mmH2O to about 200 mmH2O and have a hardness of about 85% to about 90%.

In an embodiment, the tobacco element may include a tobacco material and an aerosol-generating material.

In an embodiment, the cooling element may include a paper pipe or a hollow tube filter.

According to a second aspect of the present disclosure, an aerosol-generating system includes the smoking article according to the first aspect, and an aerosol-generating device including an accommodation space for accommodating the smoking article, a heating element for heating the smoking article, and a battery.

In an embodiment, the heating element may be inside the accommodation space and heat at least part of the first portion.

In an embodiment, the heating element may surround the accommodation space and heat at least part of the first portion.

According to a third aspect of the present disclosure, a smoking article includes a first portion including a tobacco element, a second portion including a cooling element, and a third portion including a filter element, wherein the first portion, the second portion, and the third portion are arranged in order in a longitudinal direction of the smoking article, and the smoking article further include biodegradable tip paper surrounding the second portion and the third portion.

According to a fourth aspect of the present disclosure, a smoking article includes a first segment including a tobacco element; and a second segment including a filter element, wherein the first segment and the second segment are arranged in order in a longitudinal direction of the smoking article, and the smoking article further includes biodegradable cigarette paper surrounding at least one of the first segment and the second segment.

Mode of Disclosure

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

Throughout the specification, "smoking article" refers to an article used to smoke. For example, a smoking article may include a general combustion-type cigarette that uses a method of igniting and burning the cigarette, or the smoking article may include a heating-type cigarette that uses a method of heating a cigarette with an aerosol-generating device.

Throughout the specification, "tobacco element" refers to an element including a tobacco material.

Throughout the specification, "tobacco material" refers to any type of material including components derived from tobacco leaves.

Throughout the specification, "cooling element" refers to an element that cools a material. For example, the cooling element may cool an aerosol generated in the tobacco element.

Throughout the specification, "filter element" refers to an element including a filtration material. For example, the filter element may include a plurality of strands of fibers.

Throughout the specification, a "longitudinal direction of a smoking article" refers to a direction in which a length of the smoking article is extended or a direction in which the smoking article is inserted into an aerosol-generating device.

Throughout the specification, "pore" refers to a hole through which air may pass.

Throughout the specification, "biodegradable" refers to a property capable of being decomposed by microorganisms.

Throughout the specification, "polymer" refers to a compound in which a plurality of basic units are bonded together through a chemical bond.

Throughout the specification, "cigarette paper" refers to a piece of paper surrounding part of a smoking article.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is a view schematically illustrating a smoking article 100 according to a first embodiment.

A first aspect of the present disclosure may provide a smoking article 100 that includes a first portion 110 including a tobacco element, a second portion 120 including a cooling element, and a third portion 130 including a filter element.

Referring to FIG. 1, the first portion 110, the second portion 120, and the third portion 130 may be arranged in order in a longitudinal direction of the smoking article 100. Here, the longitudinal direction of the smoking article 100 may be a direction in which a length of the smoking article 100 is extended. For example, the longitudinal direction of the smoking article 100 may be a direction from the first portion 110 toward the third portion 130.

The first portion 110 may include a tobacco element. The tobacco element may be a certain type of a tobacco material. For example, the tobacco element may have a form of cut tobacco, tobacco particles, tobacco sheet, tobacco beads, tobacco granule, or tobacco extract. In addition, a tobacco material may include, for example, one or more of a tobacco leaf, a tobacco lateral vein, puffing tobacco, cut tobacco, platelet cut tobacco, and reconstituted tobacco.

The second portion 120 may include a cooling element. The cooling element may cool an airflow passing through the first portion 110 from the outside of the smoking article 100. The cooling element may be made of a paper material and may have a cylindrical shape including a hollow core. In addition, the cooling element may be made of a polymer material or a biodegradable polymer material and may have a cooling function. For example, the cooling element may be made of polylactic acid (PLA) fiber but is not limited thereto. In addition, the cooling element may be made of a cellulose acetate filter having a plurality of perforations. However, the cooling element is not limited to the above-described example, and the present disclosure may include all materials that perform a function of cooling an airflow, without limitation. Further, the cooling element may include a tube filter or a paper pipe having a hollow core.

The third portion 130 may include a filter element. The filter element may include a cellulose acetate filter. Shapes of the filter element are not limited. For example, the filter element may include a cylinder-type rod or a tube-type rod having a hollow inside. Also, the filter element may include a recess-type rod. When the filter element includes a plurality of segments, at least one of the plurality of segments may have a different shape.

The third portion 130 may be formed to generate flavors. For example, a flavoring liquid may be injected onto the third portion 130, or an additional fiber coated with a flavoring liquid may be inserted into the third portion 130.

Also, the third portion 130 may include at least one capsule 140. Here, the capsule 140 may generate a flavor or an aerosol. For example, the capsule 140 may have a configuration in which a liquid containing a flavoring material is wrapped with a film. For example, the capsule 140 may have a spherical or cylindrical shape, but is not limited thereto.

In addition, although not illustrated in FIG. 1, the smoking article 100 may further include a plug (not illustrated). The plug may be arranged at an end of the smoking article 100. For example, the plug may be arranged at the end of the smoking article 100 adjacent to the first portion 110. The plug may function to properly adjust the entire length of the smoking article 100. In addition, when the smoking article 100 is inserted into the aerosol-generating device (not illustrated), the plug may function to adjust the first portion 110 to be placed in an appropriate position inside the aerosol-generating device.

The smoking article 100 may include at least one wrapper 150. For example, the smoking article 100 may include a first wrapper surrounding the first portion 110, a second wrapper surrounding the second portion 120, and a third wrapper surrounding the third portion 130. In addition, the smoking article 100 may include a fourth wrapper surrounding the first portion 110, the second portion 120, and the third portion 130 as a whole. In addition, the smoking article 100 may also include a fifth wrapper surrounding the second portion 120 and the third portion 130. The fifth wrapper may generally serve as tip paper.

At least one of the first wrapper to the fifth wrapper may be biodegradable cigarette paper according to the present disclosure. When the biodegradable cigarette paper is used, the smoking article 100 may be rapidly decomposed by microorganisms, and thus environmental pollution may be reduced. Characteristics of the biodegradable cigarette paper will be described in detail in a preparation example and an embodiment below.

Figure 2:
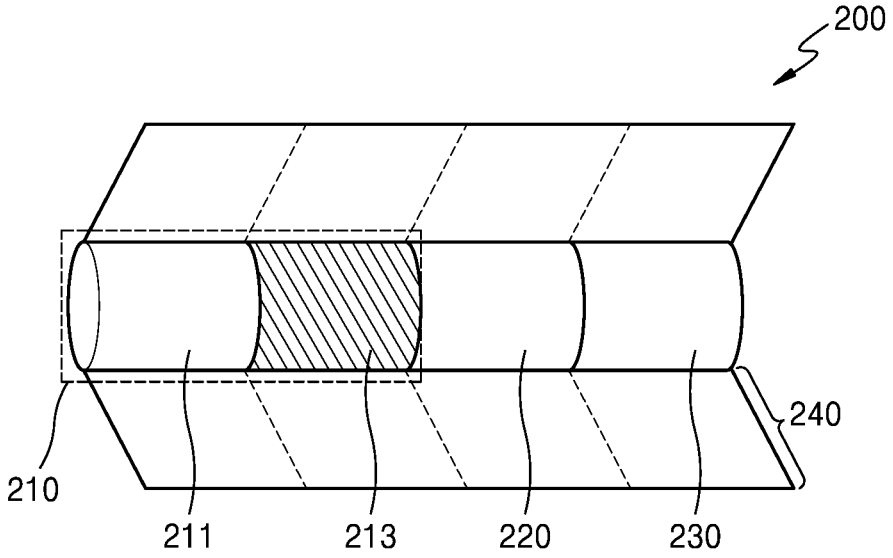
FIG. 2 is a view schematically illustrating a smoking article according to a second embodiment.

FIG. 2 is a view schematically illustrating a smoking article 200 according to a second embodiment.

Referring to FIG. 2, the smoking article 200 may include a first portion 210, a second portion 220, and a third portion 230. The second portion 220 and the third portion 230 may respectively include a cooling element and a filter element. For example, the content described above with reference to FIG. 1 may be equally applied to the second portion 220 and the third portion 230.

Referring to FIG. 2, the first portion 210 may be divided into two partitions. The first portion 210 may include an aerosol-generating base member 211 and a nicotine-generating base member 213.

The aerosol-generating base member base member 211 may include, for example, crimped paper that is impregnated with an aerosol-generating material. The aerosol-generating material may include at least one of, for example, glycerin, propylene glycol, ethylene glycol, dipropylene glycol, diethylene glycol, triethylene glycol, tetraethylene glycol, and oleyl alcohol.

The nicotine-generating base member 213 may include, for example, cut tobacco, tobacco particles, tobacco sheet, tobacco beads, or tobacco granule. As another example, the nicotine-generating base member 213 may also include crimped paper that is impregnated with tobacco extract. When the nicotine-generating base member 213 is heated, nicotine may be generated from the nicotine-generating base member 213, and the nicotine may be transferred to the second portion 220 and the third portion 230.

Figure 3:
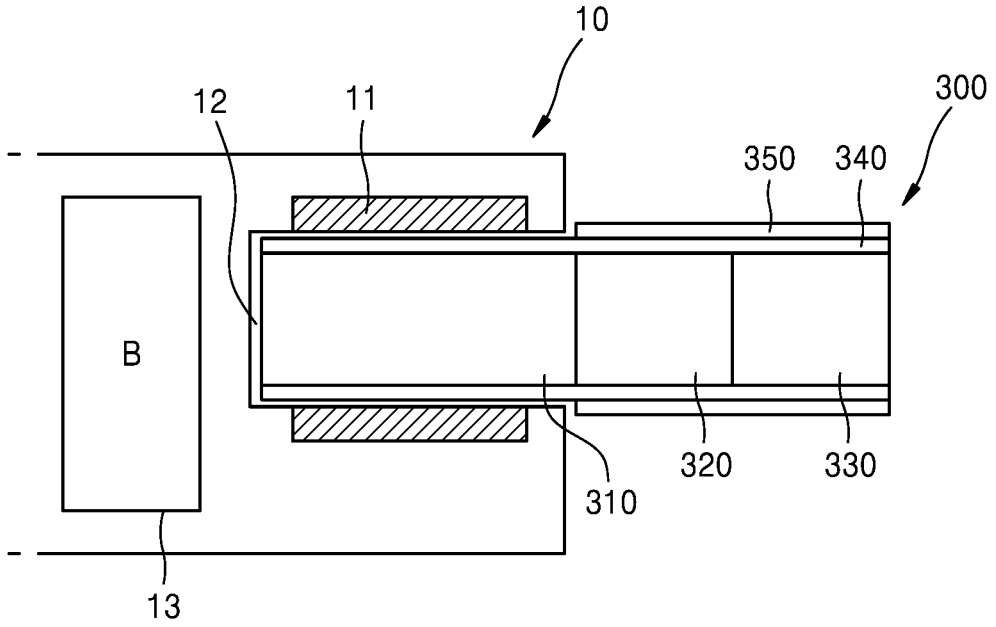
FIG. 3 is a view schematically illustrating an example in which a smoking article according to a third embodiment is inserted into an aerosol-generating device.

FIG. 3 is a view schematically illustrating an example in which a smoking article 300 according to a third embodiment is inserted into the aerosol-generating device 10.

Referring to FIG. 3, the aerosol-generating device 10 may include an accommodation space 12 for accommodating the smoking article 300, a heating element 11 for heating the smoking article 300, and a battery 13 for supplying power to the heating element 11.

The heating element 11 may be arranged inside the aerosol-generating device 10 to surround the accommodation space 12. When the smoking article 300 is inserted into the aerosol-generating device 10, the heating element 11 may be arranged inside the aerosol-generating device 10 to surround the first portion 310 of the smoking article 300. Accordingly, the heating element 11 may heat at least part of the first portion 310.

The aerosol-generating device 10 may further include a processor (not illustrated). The processor may control a temperature at which the heating element 11 heats the smoking article 300 according to a pre-input temperature profile. The heating element 11 may heat at least part of the first portion 310 in a temperature range of about 100° C. to about 400° C.

The smoking article 300 may include a first portion 310 including a tobacco element, a second portion 320 including a cooling element, and a third portion 330 including a filter element.

In addition, the smoking article 300 may further include a first wrapper 340 and a second wrapper 350. The first wrapper 340 may be arranged to cover the first portion 310, the second portion 320, and the third portion 330, and the second wrapper 350 may be arranged to cover the second portion 320 and the third portion 330. The second wrapper 350 may function as tip paper in a general combustion-type cigarette or a heating-type cigarette.

In FIG. 3, thicknesses of the first wrapper 340 and the second wrapper 350 of the smoking article 300 are somewhat exaggerated, but the thicknesses of the first wrapper 340 and the second wrapper 350 may be, for example, several micrometers, and thus, an outer surface of the smoking article 300 may be formed to be substantially smooth.

At least one of the first wrapper 340 and the second wrapper 350 may be biodegradable cigarette paper. The biodegradable cigarette paper may include a biodegradable polymer. The biodegradable polymer may be, for example, polylactic acid (PLA) or polybutylene adipate terephthalate (PBAT). In addition, the biodegradable cigarette paper may be made by combining two or more biodegradable polymers. For example, the biodegradable cigarette paper may be made by mixing PLA and PBAT in a weight ratio of 0.1 to 10:1. As a specific example, the biodegradable cigarette paper may be made by mixing PLA and PBAT in a weight ratio of about 3:7. Accordingly, the biodegradable cigarette paper may be further improved in biodegradability. In addition, the biodegradable cigarette paper may be completely decomposed after 200 days in composting conditions of a temperature of 58° C. and humidity of 70%.

In addition, the biodegradable cigarette paper may further include an amide-based compound and an ethylene bis compound. As a specific example, the biodegradable cigarette paper may include a C16-C18 amide-based compound and N,N' ethylenebis.

In addition, the biodegradable cigarette paper may further include calcium carbonate ($CaCO_3$). When the biodegradable cigarette paper further includes calcium carbonate, printability on a surface of the biodegradable cigarette paper may be improved.

The biodegradable cigarette paper may include, for example, a vinyl material. In addition, the biodegradable cigarette paper may not have pores and may have a basis weight of about 100 to about 130 $g/m^2$ and may have a tensile strength of about 3 to about 8 kgf/15 mm.

Hereinafter, a preparation example of biodegradable cigarette paper according to the present disclosure, and embodiments and experimental examples of smoking articles to which the preparation example is applied will be described in detail.

Preparation Example

In consideration of biodegradability of biodegradable cigarette paper, content ratios of PLA and PBAT of a biodegradable polymer was adjusted. The biodegradable cigarette paper was made by mixing PLA and PBAT in a weight ratio of 3:7. The biodegradable polymer was set to about 90 to 95% of a total weight of the biodegradable cigarette paper. When a cigarette filter is manufactured by using the biodegradable cigarette paper, a target tensile strength was set to 7.0 kgf/15 mm or more. In addition, calcium carbonate (CaCO3) was added by considering coating and characteristics of smoothness of a surface for manufacturing a filter or tip paper. In addition, a C16-C18 amide-based compound and N,N' ethylenebis were added.

Embodiment

1. Properties of Manufactured Biodegradable Cigarette Paper

TABLE 1

| Item | Unit | Biodegradable vinyl cigarette paper |
|---|---|---|
| Thickness | μm | 92.6 ± 1.4 |
| Porosity | $cm^2/cm^2$, min, 1 kPa | 0 |
| Degree of water resistance | % | 0 |
| Basis weight | $g/m^2$ | 121.1 ± 1.6 |
| Tensile strength | Kgf/15 mm | 5.4 ± 0.5 |
| Elongation rate | % | 371.3 ± 29.9 |
| Stiffness | $cm^3$ | 240 or more |
| Ash content | % | 5.6 |
| Whiteness index | % | 77.3 ± 0.3 |
| Opacity | % | 55.8 ± 0.7 |

2. Properties of Filter Element Having Biodegradable Cigarette Paper Applied Thereto

TABLE 2

| | Raw material | | | Physicochemical property | | | | | | | |
|---|---|---|---|---|---|---|---|---|---|---|---|
| | | | | | Circumference(mm) | | Suction resistance (mmH2O) | | | | |
| classification | Main material | Filter paper Porosity (CU) | Plasticizer Content (%) | Length (mm) | Individual value | Average value | Individual value | Average value | Rod weight (mg) | Hardness (%) | Roundness (%) |
| Ace general | 9.0Y 25K | Biodegradable cigarette paper (No pore) Width 24.5 mm | TA 15 ± 2 | 96.0 ± 0.4 | 22.00 ± 0.20 | 22.00 ± 0.06 | 170 ± 26 | 170 ± 12 | 665 ± 66 | 85 or more | 93 or more |

Experimental Example

Biodegradation experiments for Comparative Examples and Embodiments were conducted as follows, and analysis results were illustrated. Analysis conditions were set equally at a temperature of 58° C. and humidity of 70%. In the biodegradation experiment, primary decomposition was performed in composting, and secondary decomposition was performed by microorganisms (bacteria, mold, and so on).

TABLE 3

| Sample | | Analysis condition | Analysis result (unit: wt %) |
|---|---|---|---|
| Comparative Example 1 | Application of general cigarette paper Mono acetate filter | composting conditions of 58° C. and 70% (Based on 20 pieces) | Cigarette: 93% decomposition after 200 days Tow: 20% decomposition after 200 days |
| Embodiment 1 | Biodegradable cigarette paper-applied mono acetate filter | composting conditions (based on 20 pieces) of 58° C. and 70% | Cigarette paper: 100% decomposition after 200 days Tow: 35% decomposition after 200 days |

TABLE 3-continued

| Sample | | Analysis condition | Analysis result (unit: wt %) |
|---|---|---|---|
| Comparative Example 2 | General tip paper-applied filter | composting conditions (based on 20 pieces) of 58° C. and 70% | Tip paper: 90% decomposition after 200 days<br>Cigarette: 80% decomposition after 200 days<br>Tow: 10% decomposition after 200 days |
| Embodiment 2 | Biodegradable tip paper-applied filter | composting condition (based on 20 pieces) of 58° C. and 70% | Tip paper: 100% decomposition after 200 days<br>Cigarette paper: 100% decomposition after 200 days<br>Tow: 25% decomposition after 200 days |

In Comparative Example 1 and Embodiment 1, biodegradable cigarette paper was arranged to cover a filter element of a smoking article. As a result of the experiment, biodegradable cigarette paper of Embodiment 1 was decomposed by 100% after 200 days, and filter tow of Embodiment 1 was decomposed by 35% after 200 days. Referring to Embodiment 1, it can be seen that biodegradability of a filter element is improved compared to Comparative Example 1. In Comparative Examples 2 and Embodiment 2, biodegradable cigarette paper was arranged to cover a cooling element and a filter element of a smoking article. The biodegradable cigarette paper was used as tip paper and a filter paper, and as a result of the experiment, the biodegradable cigarette paper and biodegradable tip paper of Embodiment 2 were decomposed by 100% after 200 days, and the filter tow of Embodiment 2 was decomposed by 25% after 200 days. Referring to Embodiment 2, it can be seen that biodegradability of a filter element is improved, compared to Comparative Example 2. When biodegradable cigarette papers of Embodiment 1 and Embodiment 2 were excellent in adhesiveness without using a separate adhesive even when heat of about 80° C. was applied at a working speed of 3,000 cpm.

In addition, because the biodegradable cigarette papers of Embodiment 1 and Embodiment 2 had no pores (0 CU), it was confirmed that the amount of atomization delivered to smokers increased when applied to smoking articles.

In addition, because the biodegradable cigarette papers of Embodiment 1 and Embodiment 2 had no pore (0 CU), it was confirmed that leakage of the capsule contents was reduced when s flavor capsule was applied to a filter element.

In addition, it was confirmed that the biodegradable cigarette papers of Embodiment 1 and Embodiment 2 were as vinyl materials and did not require coating of a water-resistant material for lip release.

In addition, when the biodegradable cigarette paper was used as tip paper as in Embodiment 2, it was confirmed that printability for design application was excellent. As a kind of ink that may be used for tip paper, it is confirmed that the following materials may be used.

TABLE 4

| Item | Kinds |
|---|---|
| Binder | Nitrocellulose, IPA, resin (polyamide, rosin), maleic anhydride, wax, ethyl acetate, and so on. |
| Solvent | Ethyl/methyl/propyl acetate, ethyl alcohol, IPA, alcohol, water, propylene alcohol, ethanol, and so on |

TABLE 4-continued

| Item | Kinds |
|---|---|
| Pigment | Not limited (various colors may be provided through use of pigments of C, M, and Y) |

In addition, biodegradable cigarette paper (including tip paper) according to the present disclosure may be used in general combustion-type smoking articles. A fourth aspect of the present disclosure may include a first segment including a tobacco element and a second segment including a filter element, and the first segment and the second segment may be arranged in order in a longitudinal direction of the smoking article, and the smoking article may further include biodegradable cigarette paper surrounding at least one of the first segment and the second segment. The above-described contents of the first to third aspects may be equally applied to the fourth aspect of the present disclosure. However, the smoking article according to the fourth aspect of the present disclosure may include, for example, a combustion-type cigarette including a first segment including cut tobacco and a second segment including a filter element.

Biodegradable cigarette paper may serve as filter paper surrounding each of the first segment and the second segment, and as another example, the biodegradable cigarette paper may also serve as tip paper surrounding part of the first segment and all of the second segment.

Those of ordinary skill in the art related to the present embodiments may understand that various changes in form and details may be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

The invention claimed is:

1. A smoking article comprising:

a first portion including a tobacco element;

a second portion including a cooling element; and a third portion including a filter element, wherein the first portion, the second portion, and the third portion are arranged in order in a longitudinal direction of the smoking article, the smoking article further comprises biodegradable cigarette paper surrounding at least one of the second portion and the third portion, the biodegradable cigarette paper has no pores, the biodegradable cigarette paper includes a biodegradable polymer, and the biodegradable polymer includes polylactic acid (PLA) and polybutylene adipate terephthalate (PBAT) in a weight ratio of 0.1 to 10:1.

2. The smoking article of claim 1, wherein the biodegradable cigarette paper further includes calcium carbonate ($CaCO_3$).

3. The smoking article of claim 1, wherein the biodegradable cigarette paper is completely decomposed after 200 days in composting conditions of a temperature of 58° C. and humidity of 70%.

4. The smoking article of claim 1, wherein the biodegradable cigarette paper has a basis weight of about 100 g/$m^2$ to about 130 g/$m^2$ and has a tensile strength of about 3 kgf/15 mm to about 8 kgf/15 mm.

5. The smoking article of claim 1, wherein, when the biodegradable cigarette paper surrounds the third portion, the third portion has suction resistance of about 150 mm $H_2O$ to about 200 mm $H_2O$ and has a hardness of about 85% to about 90%.

6. The smoking article of claim 1, wherein the tobacco element includes a tobacco material and an aerosol-generating material.

7. The smoking article of claim 1, wherein the cooling element includes a paper pipe or a hollow tube filter.

8. The smoking article of claim 1, wherein the biodegradable cigarette paper further includes a C16-C18 amide-based compound and/or N,N' ethylenebis.

9. An aerosol-generating system comprising:

the smoking article of claim 1; and an aerosol-generating device including an accommodation space for accommodating the smoking article, a heating element for heating the smoking article, and a battery.

10. The aerosol-generating system of claim 9, wherein the heating element is inside the accommodation space and heats at least part of the first portion.

11. The aerosol-generating system of claim 9, wherein the heating element surrounds the accommodation space and heats at least part of the first portion.

* * * * *